US008639167B2

(12) United States Patent
Nakayama et al.

(10) Patent No.: US 8,639,167 B2
(45) Date of Patent: Jan. 28, 2014

(54) DEVELOPING DEVICE AND IMAGE FORMING DEVICE

(75) Inventors: Kanji Nakayama, Toyokawa (JP); Masayasu Haga, Toyokawa (JP); Tomohisa Yoshida, Toyokawa (JP); Wataru Onoda, Toyokawa (JP); Yoshiyuki Iguchi, Toyokawa (JP); Noboru Ito, Kawanishi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 183 days.

(21) Appl. No.: 13/173,928

(22) Filed: Jun. 30, 2011

(65) Prior Publication Data

US 2012/0003014 A1 Jan. 5, 2012

(30) Foreign Application Priority Data

Jul. 2, 2010 (JP) ..... 2010-152541

(51) Int. Cl.
*G03G 15/095* (2006.01)
*G03G 15/08* (2006.01)

(52) U.S. Cl.
USPC ..... 399/284

(58) Field of Classification Search
USPC ..... 399/284
See application file for complete search history.

(56) References Cited

U.S. PATENT DOCUMENTS

| | | | | |
|---|---|---|---|---|
| 4,194,830 | A * | 3/1980 | Ohnuma et al. | 399/284 |
| 4,453,493 | A * | 6/1984 | Sawayama et al. | 399/254 |
| 5,617,189 | A * | 4/1997 | De Cock et al. | 399/254 |
| 6,343,201 | B1 * | 1/2002 | Wada et al. | 399/281 |
| 6,522,855 | B1 * | 2/2003 | Katoh et al. | 399/274 |
| 7,050,745 | B2 * | 5/2006 | Kikuchi | 399/272 |
| 8,238,803 | B2 * | 8/2012 | Anderson et al. | 399/284 |
| 2003/0086728 | A1 | 5/2003 | Kikuchi | |
| 2006/0204283 | A1 | 9/2006 | Yasuda | |

FOREIGN PATENT DOCUMENTS

| | | |
|---|---|---|
| JP | 10-133480 | 5/1998 |
| JP | 2003-107860 | 4/2003 |
| JP | 2006-251440 | 9/2006 |
| JP | 2008-015197 | 1/2008 |

OTHER PUBLICATIONS

Notification of Reasons of Rejection mailed Apr. 17, 2012, directed to Japanese Application No. 2010-152541; 4 pages.
Notification of Reasons of Rejection mailed Jul. 3, 2012, directed to Japanese Application No. 2010-152541; 5 pages.

* cited by examiner

*Primary Examiner* — Clayton E Laballe
*Assistant Examiner* — Leon W Rhodes, Jr.
(74) *Attorney, Agent, or Firm* — Morrison & Foerster LLP

(57) ABSTRACT

A two-component developing device using a developer containing toner and magnetic carrier particles. The developing device comprises a housing, a developing roller, a magnetic field generator mounted inside the developing roller, and a developer restricting member, and further comprises a developer guide member providing a developer guide path for guiding the developer to the developer amount restricting clearance, providing a developer circulation path for circulating the developer to an upstream end of the guide member, and providing a communication path for bringing the developer guide path into communication with the developer circulation path, an upstream end of the guide member being positioned above the position of a peak of magnetic flux density of the magnetic pole of the magnetic field generator which is closest to a low-magnetic force area downstream of the low-magnetic force area or positioned upstream of such a position and downstream of the low-magnetic force area. An image forming device in which such a two-component developing device is employed as at least one developing device.

10 Claims, 3 Drawing Sheets

DEVELOPING DEVICE AND IMAGE FORMING DEVICE

CROSS-REFERENCE TO RELATED APPLICATION

This invention is based on Japanese Patent Application No. 2010-152541 filed in Japan on Jul. 2, 2010, the entire content of which is hereby incorporated by reference.

BACKGROUND OF THE INVENTION

1. Field of the Invention

The present invention relates to an image forming device such as a copying machine, a printer, a facsimile machine, or a multi-functional peripheral machine which is a combination of two or more of these, especially to a developing device used for the image forming device, and further especially to a two component developing device which is capable of forming a toner image by developing an electrostatic latent image formed on an electrostatic latent image carrier with a developer containing toner and magnetic carrier particles in the image forming device.

2. Description of Related Art

In an image forming device such as a copying machine, a printer, a facsimile machine, or a multi-functional peripheral machine which is a combination of two or more of these, a common two-component developing device which is capable of forming a toner image by developing an electrostatic latent image formed on an electrostatic latent image carrier with a developer containing toner and magnetic carrier particles comprises a development housing for containing a developer, a developing roller which is provided on the development housing and can be rotationally driven, a magnetic field generator which is mounted inside the developing roller, and has a plurality of magnetic poles for attracting developer in a development housing used for development onto the surface of the developing roller and meanwhile for providing a low-magnetic force area where the developer returned into the development housing without being used in development in a state of being left attracted on the developing roller is separated from the developing roller, and a developer restricting member which restricts the amount of the developer attracted onto the surface of the developing roller by the magnetic force of the magnetic field generator and transferred to an electrostatic latent image development area by the rotation of the developing roller, and opposes the developing roller across a developer amount restricting clearance.

FIG. 5 shows an example of such a conventional developing device.

A two-component developing device 4' shown in FIG. 5 comprises a development housing 40' for containing a developer D, a developing roller 41' which is provided on the development housing 40' and can be rotationally driven, a magnetic field generator 42' mounted inside the developing roller 41', an a developer restricting member 43' opposing the developing roller 41'.

The developing device 4' further comprises a rotationally driven developer transfer member 401' which transfers the developer D in the development housing 40' and at the same time distributes the same entirely to the developing roller 41'.

As shown in FIG. 5, the developer transfer member 401' is generally disposed with its rotational axis aligned to the developing roller 41'.

A developing device provided with another developer transfer member (not shown) disposed therein which reciprocatingly circulates and transfers the developer by this another transfer member and the transfer member 401' and distributes the developer to the developing roller 41' is also widely known.

The magnetic field generator 42' has a plurality of magnetic poles which attract the developer used in development in the development housing 40' onto the surface of the developing roller 41', and meanwhile provide a low-magnetic force area LM' where the developer returned into the development housing 40' without being used in development in a state of being left attracted is separated from the developing roller 41'.

In the example of FIG. 5, the magnetic field generator 42' has, although not so limited, a catch pole S2 which attracts the developer D onto the developing roller 41', a restricting pole N2 located in a position corresponding to the restricting member 43', a transfer pole S1 for transferring the developer which has passed the restricting member 43' to a development area Da' where an electrostatic latent image on the electrostatic latent image carrier 1' is developed, and a developer separating pole S3 which forms a repulsion magnetic field between the development pole N1 corresponding to the development area Da' and the catch pole S2 to form the low-magnetic force area LM'.

The developer attracted onto the surface of the developing roller 41' by the magnetic force of the magnetic field generator 42' is transferred to a developer amount restricting clearance where the developer restricting member 43' opposes the developing roller 41' under the action of the frictional force by the rotation of the developing roller 41', and is restricted to a predetermined amount in the clearance and transferred to the electrostatic latent image development area Da', and is subjected to the development of an electrostatic latent image on the electrostatic latent image carrier 1'.

The developer which was not consumed in the development area Da' and returned to the development housing 40' in a state of being retained on the developing roller 41' peels off from the developing roller in the low-magnetic force area LM'. The low-magnetic force area LM' has a magnetic flux density of, for example, 5 mT or lower on the surface of the developing roller 41'.

In either case, the normal reaction which generates the frictional force for transferring developer by the rotation of the developing roller is mainly a component of the magnetic force due to the magnetic field generated by the magnetic field generator which is mounted inside the developing roller in the radial direction of the developing roller. The distribution of magnetic flux density on the surface of the developing roller which has a commonly used magnetic field generator thereinside to generate this normal reaction required for transferring developer, in other words, a component of the magnetic force of the magnetic field generator in the radial direction of the developing roller is approximately a few tens to a hundred mT.

Regarding this point, JP2008-15197A describes the following developing device. That is, the document describes that, to improve the ability of the developing roller to transfer developer, a developer slip restricting member is disposed in a manner of opposing and being spaced away from the developing roller in an upstream area of the developer restricting member. The developer is pressed against the developing roller by this component to suppress slipping of the developer with respect to the developing roller, in other words, the developer is pressed against the developing roller to ensure the frictional force required for transfer of the developer between the developing roller and the developer.

In a conventional two-component developing device as described above, except for the developing device described in JP2008-15197A, the amount of the developer attracted onto the developing roller by the magnetic force of the magnetic field generator is varied depending on change of the bulk of the developer and the position of a developer transfer member such as the above-mentioned developer transfer member 401' which is usually provided on a two-component developing device and uneven transfer of the developer. This variation of the amount of the developer on the developing roller may lower the quality of images developed and formed.

Therefore, as an effective measure for equalizing the amount of the developer transferred to the development region without being affected by the variation of the amount of the developer attracted onto the developing roller, a measure is employed in many developing devices which supplies developer to the developing roller in an amount larger than that to be transferred to the development region (having the developing roller attracting such an amount of developer) and restricts the amount of the developer under a certain pressure by a developer restricting member.

However, the high pressure which acts on the developer in the restricting portion by the developer restricting member is a stress for the developer, which deteriorates the developer in the use of the developing device for a long period of time. For this reason, it is required to set the pressure acting on the developer in the restricting portion to a low level.

Described more specifically, developer, when its movement toward the development region is restricted by the developer restricting member, is bound close to the developing roller by magnetic force. Therefore, an accumulating portion of the developer is produced in an upstream area of the developer restricting member in the direction of rotation of the developing roller (in the device 4' in FIG. 5, upstream area Ar), where the stress on the developer is increased.

By reducing the amount of the developer attracted onto the developing roller, the amount of the developer which needs to be restricted can be also reduced. However, the amount of the developer accumulating at the restricting member is determined by the structural conditions and magnetic force around the developer restricting portion. Therefore, as long as restriction of the amount is performed in the restricting portion, the amount is:

Amount of the developer on the developing roller before passing the restricting member>amount of the developer after passing the restricting member Consequently, the amount of the developer accumulating cannot be reduced, and reducing stress of the developer is thus difficult.

The developing device 4" shown in FIG. 6 is a variation of the developing device 4' shown in FIG. 5 where the space Ar' on the upstream side of the developer restricting member 43' is set smaller. By setting the space on the upstream side of the developer restricting member 43' smaller in such a manner, the accumulating portion of the developer is unlikely to be produced on the upstream side of the restricting member, and the amount of the developer which receives stress before being restricted is reduced. However, on the contrary, the developer is packed and the stress exerted on each (individual) particle constituting the developer is increased.

In a developing device of the type described in JP2008-15197A, the slip restricting member and the developer restricting member are spaced away from each other, whereby pressure is released so that the stress on the developer in the restricting portion can be suppressed. However, the amount of the developer fed is restricted at the upstream end of the slip restricting member (the upstream end in the direction of rotation of the developing roller), and the developer is therefore accumulated in the portion and the stress on the developer is generated. Such stress on the developer also occurs in this type of device.

SUMMARY OF THE INVENTION

The present invention provides a two-component developing device which is capable of forming a toner image by developing an electrostatic latent image formed on an electrostatic latent image carrier with a developer containing toner and magnetic carrier particles, the two-component developing device comprising a development housing for containing the developer, a developing roller which is provided on the development housing and can be rotationally driven, a magnetic field generator mounted inside the developing roller and having a plurality of magnetic poles for attracting the developer used for development in the development housing onto a surface of the developing roller and meanwhile for providing a low-magnetic force area where the developer returned into the development housing without being used in development in a state of being left attracted on the developing roller is separated from the developing roller, a developer restricting member which restricts an amount of the developer attracted onto the surface of the developing roller by the magnetic force of the magnetic field generator and transferred to an electrostatic latent image development area by rotation of the developing roller, the developer restricting member opposing the developing roller across a developer amount restricting clearance, the two-component developing device comprising a developer guide member disposed between the developing roller and an inner face of the development housing in an area upstream of the developer restricting member in a direction of rotation of the developing roller, the guide member providing a developer guide path for guiding the developer to a developer amount restricting clearance between itself and the developing roller, providing a developer circulation path for circulating the developer to an upstream end of the guide member in the direction of rotation of the developing roller between itself and the inner face of the development housing, and providing a communication path for bringing the developer guide path into communication with the developer circulation path at a downstream end portion of the guide member in the direction of rotation of the developing roller, and the upstream end of the guide member in the direction of rotation of the developing roller being positioned above a peak of a magnetic flux density of the magnetic pole of the magnetic field generator which is closest to the low-magnetic force area downstream of the low-magnetic force area or positioned upstream of such a position and downstream of the low-magnetic force area.

The present invention also provides an image forming device comprising an electrostatic latent image carrier and a plurality of developing devices for developing a latent image on the electrostatic latent image carrier, at least one of the plurality of the developing devices being the above-mentioned two-component developing device.

The foregoing and other objects, features, aspects and advantages of the present invention will become more apparent from the following detailed description of the preferred embodiments of the present invention when taken in conjunction with accompanying drawings.

DESCRIPTION OF THE PREFERRED EMBODIMENTS

Figure 1:
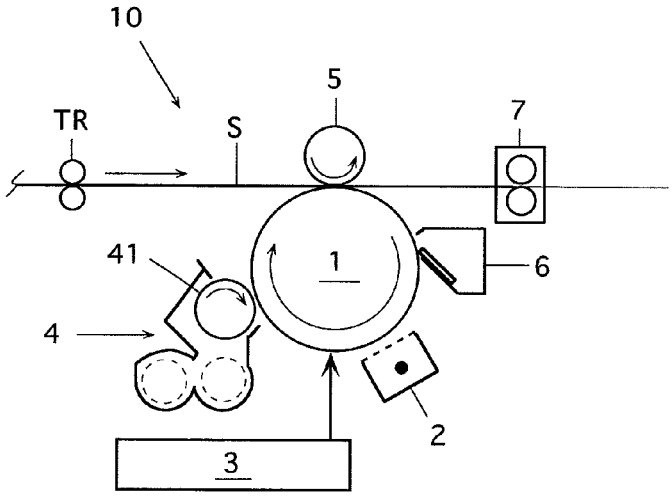
FIG. 1 shows the outline of the constitution of an example of the image forming device according to the present invention.

A developing device and an image forming device of an embodiment of the present invention are basically as follows:

(1) Developing Device

A two-component developing device which is capable of forming a toner image by developing an electrostatic latent image formed on an electrostatic latent image carrier with a developer containing toner and magnetic carrier particles.

The two-component developing device comprises a development housing for containing the developer, a developing roller which is provided on the development housing and can be rotationally driven, a magnetic field generator mounted inside the developing roller and having a plurality of magnetic poles for attracting the developer used for development in the development housing onto a surface of the developing roller and meanwhile for providing a low-magnetic force area where the developer returned into the development housing without being used in development in a state of being left attracted on the developing roller is separated from the developing roller, a developer restricting member which restricts an amount of the developer attracted onto the surface of the developing roller by the magnetic force of the magnetic field generator and transferred to an electrostatic latent image development area by rotation of the developing roller, the developer restricting member opposing the developing roller across a developer amount restricting clearance.

The two-component developing device further comprises a developer guide member disposed between the developing roller and an inner face of the development housing in an area upstream of the developer restricting member in a direction of rotation of the developing roller, the guide member providing a developer guide path for guiding the developer to a developer amount restricting clearance between itself and the developing roller, providing a developer circulation path for circulating the developer to an upstream end of the guide member in the direction of rotation of the developing roller between itself and the inner face of the development housing, and providing a communication path for bringing the developer guide path into communication with the developer circulation path at a downstream end portion of the guide member in the direction of rotation of the developing roller, the upstream end of the guide member in the direction of rotation of the developing roller being positioned above a peak of a magnetic flux density of the magnetic pole of the magnetic field generator which is closest to the low-magnetic force area downstream of the low-magnetic force area or positioned upstream of such a position and downstream of the low-magnetic force area.

(2) Image Forming Device

An image forming device comprising an electrostatic latent image carrier and a plurality of developing devices for developing a latent image on the electrostatic latent image carrier, and at least one of the plurality of the developing devices being the two-component developing device according to (1) above.

According to the above two-component developing device, the amount of the developer fed onto the developing roller is limited by the upstream end of the developer guide member in the direction of rotation of the developing roller. The upstream end of the guide member is positioned above the peak of a magnetic flux density of the magnetic pole of the magnetic field generator which is closest to the low-magnetic force area downstream of the low-magnetic force area (in other words, in a position corresponding to the peak of the magnetic flux density) or positioned upstream of such a position and downstream of the low-magnetic force area. Therefore, the ability of the developing roller to attract the developer in a region including the upstream end of the guide member is not very high, and the stress of the developer in the region is suppressed to a low level.

Furthermore, two flow paths for the developer before the developer amount restricting portion by the developer restricting member are formed by the guide member.

Path 1: Space formed between the developing roller and the guide member (developer guide path).

In this path 1, the developer is transferred in the same direction as the direction of rotation of the developing roller.

Path 2: Space formed between the guide member and the development housing (developer circulation path).

In this path 2, the developer travels in the direction opposite to the direction of rotation of the developing roller. The developer which has been prevented from being transferred to the development region by the developer restricting member flows into this developer circulation path from the communication path which brings the developer guide path into communication with the developer circulation path, and travels through this path.

Since the interval between the guide member and the surface of the developing roller in the path 1 is limited by the guide member, the amount of the developer accumulated in the developer restricting portion which is transferred through this path 1 is lower than in the case where no guide member is provided.

Furthermore, the pressure of the developer before the developer restricting portion is released by the communication path which brings the path 1 (developer guide path) into communication with the path 2 (developer circulation path), and the developer before the developer restricting portion is returned to the upstream end of the guide member (feed portion of the developer) through the path 2, whereby the pressure of the developer before the developer restricting portion is prevented from becoming too high.

Thus, the amount of the developer accumulated in an upstream area adjacent to the developer restricting member in the direction of rotation of the developing roller can be reduced while suppressing the stress on each particle constituting the developer, whereby the stress on the developer in the upstream area adjacent to the developer restricting member can be reduced.

Moreover, the above two-component developing device is employed as at least one developing device in the above image forming device and therefore stress on the developer is suppressed in the developing device. Hence, deterioration of the developer caused when the stress on the developer is high and image defects caused thereby, as well as other problems, are suppressed, and good images can be formed accordingly. The image forming device as a whole can also form good images accordingly.

In the above two-component developing device, the developer circulation path can be, for example, a path for circulating the developer which flows into itself to the upstream end of the guide member by gravity. However, the developer circulation path may be provided with a developer transfer member such as a rotation paddle which can transfer the developer which flow into itself to the upstream end of the guide member.

Examples of the image forming device and the developing device will be described below with reference to drawings.

FIG. 1 shows the outline of the constitution of an example of the image forming device.

An image forming device 10 shown in FIG. 1 is an electrophotographic image forming device which forms a monochrome image on a recording sheet S such as a recording paper sheet.

The image forming device 10 comprises a photosensitive member (drum) 1, and a charger (electrifying device) 2, an image exposure device 3, a developing device 4, a transfer roller 5 and a cleaning device 6 which are disposed around the photosensitive member 1 in the order stated.

The image forming device 10 also comprises a recording sheet feed portion (not shown), and a fixing device 7 and a sheet discharge tray (not shown) etc., downstream of the transfer roller 5 in the direction of transfer of the sheet S fed from the recording sheet feed portion.

The photosensitive member 1 is a negatively chargeable photosensitive member, whose surface can be uniformly charged to a predetermined negative potential by the charger 2.

The image exposure device 3 is for forming an electrostatic latent image depending on an image to be formed by subjecting a charged area by the charger 2 of the photosensitive member 1 to an image exposure. The image exposure device 3 performs the image exposure depending on image information provided from an image scanner (not shown), a computer, an external facsimile machine and other devices.

The developing device 4 is a two-component developing device which develops an electrostatic latent image on the photosensitive member 1 using a two-component developer containing toner and magnetic carrier particles, and forms a visible toner image from the electrostatic latent image with the negatively charged toner by reversal development. The developing device 4 will be described later in further detail.

According to the image forming device 10, a toner image can be formed on the sheet S in the following manner:

The surface of the photosensitive member 1 which is rotationally driven by a photosensitive member drive motor (not shown) in the clockwise direction in the FIG. 1 is uniformly charged to a predetermined potential by the charger 2 to which an charging voltage is applied from an charging power source (not shown). The charged area is subjected to image exposure from the image exposure device 3 to form an electrostatic latent image depending on an image to be formed, and this electrostatic latent image is developed by the two-component developing device 4 to form a toner image.

Meanwhile, the recording sheet S is fed from the recording sheet feed portion (not shown) to a timing roller TR, and inserted and passed through a transfer portion between the photosensitive member 1 and the transfer roller 5 by the timing roller TR at such a timing that the toner image is transferred onto an area of the sheet S in which an image is to be formed. At this time, a transfer voltage is applied from a transfer power source (not shown) to the transfer roller 5, so that the toner image on the photosensitive member 1 is transferred onto the sheet S.

The recording sheet S onto which the toner image is transferred in such a manner passes through the fixing device 7 so that the toner image is fixed with heating under increased pressure, and is discharged onto the sheet discharge tray.

The surface of the photosensitive member 1 after the transfer of the toner image is cleaned by the cleaning device 6, and is prepared for the next image formation.

The two-component developing device 4 will be further described.

Figure 2:
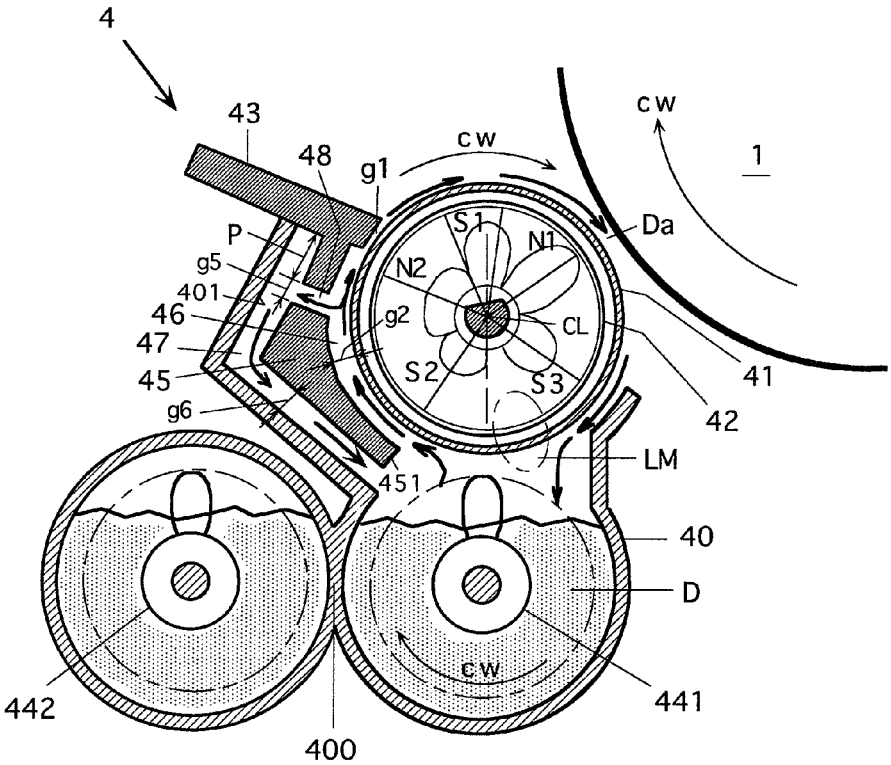
FIG. 2 is a schematic cross-sectional view of an example of the two-component developing device according to the present invention employed in the image forming device of FIG. 1.
Figure 3:
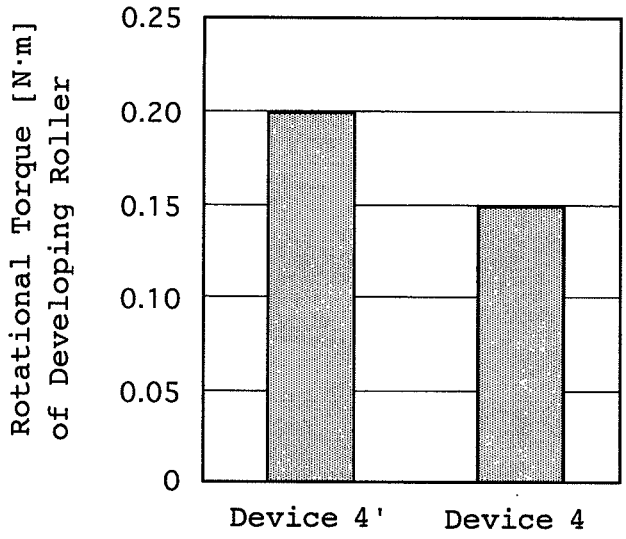
FIG. 3 shows the comparison of the results of the developing roller rotational torques determined in a developing device of Example and a developing device of a conventional example, respectively.

FIG. 2 shows a schematic cross-sectional structure of the two-component developing device 4 employed in the image forming device 10 of FIG. 1.

The developing device 4 comprises a development housing 40 for containing a so-called two-component developer D containing toner and magnetic carrier particles, a developing roller 41 rotatably attached to the development housing 40, a magnetic field generator 42 mounted inside the developing roller 41, and a developer restricting member 43 provided adjacent to the developing roller 41 across a developer amount restricting clearance g1.

The developing roller 41 is a sleeve-shaped non-magnetic member, which is also referred to as development sleeve, and its surface is given a roughness suitable for transferring the developer D by the blast process or a like process. The outer diameter of the developing roller 41 is, but is not limited to, 16 mm in this example.

The developer restricting member 43 is formed of a magnetic material.

The developing roller 41 opposes the photosensitive member 1 from an opening portion which opens to the photosensitive member 1 of the development housing 40 across a development clearance Da, and can be rotationally driven in the clockwise direction CW in FIG. 2 by a developing motor (not shown). The developing roller 41 extends in the direction of a center line CL of rotation thereof so that it can cope with the width of the recording sheet S on which an image is to be formed.

The developing device 4 further comprises a pair of developer transfer members 441, 442 for stirring the developer (and thus electrifying the toner by friction) and at the same time transferring the developer along the longitudinal direction of the developing roller 41 (the direction of the center line of rotation CL), and distributing the developer to the respective portions of the developing roller 41 for retaining the developer.

The developer transfer members 441, 442 are rotatably disposed in the development housing 40 parallel to the developing roller 41. The developer transfer members 441, 442 are screw conveyors in this example, and can be rotationally driven by the developing motor (not shown) via a transmission mechanism.

In FIG. 2, the developer D is circulated as follows: it is transferred from the front side to the back side by one of the transfer members 441, moved from an opening (not shown) formed in a back portion of a partition wall 400 provided between the two transfer members to the other transfer member 442, transferred from the back side to the front side by the transfer member 442, and is moved from an opening (not shown) formed in a front portion of the partition wall 400 to the transfer member 441.

The transfer member 441 opposing the developing roller 41 transfers the developer D along the longitudinal direction of the developing roller 41 and at the same time distributes the developer to the respective portions of the developing roller. A toner replacement can be fed, for example, in the back portion of the transfer member 442.

The magnetic field generator 42 attracts the developer D used in development in the development housing 4 onto the surface of the developing roller 41, and meanwhile provides a low-magnetic force area LM where the developer D returned to the development housing 4 without being used in development in a state of being left attracted on the developing roller 41 is separated from the developing roller 41.

Explained more specifically, the magnetic field generator 42 is, but is not limited to, a combination of permanent magnets arranged in the form of a roll in this example, and has magnetic poles, S-poles and N-poles, on its peripheral surface.

The magnetic field generator 42 has, as magnetic poles, a catch pole S2 which attracts the developer D onto the developing roller 41, a restricting pole N2 located in a position corresponding to the restricting member 43, a transfer pole S1 for transferring the developer which has passed the developer amount restricting clearance g1 by the restricting member 43 to the development area Da in which the electrostatic latent image on the photosensitive member 1 is developed, and a developer separating pole S3 which forms a repulsion magnetic field between the development pole N1 corresponding to the development area Da and the catch pole S2 to form the low-magnetic force area LM.

The positions of the magnetic poles in the magnetic field generator 42 are not limited to this instance. Other arrangements of the magnetic poles are also possible as long as they do not affect development of the electrostatic latent image.

In this example, the toner constituting the developer D is, but is not limited to, a toner produced by polymerization with a mean particle size of 6 μm, which is used by being negatively electrified, while the magnetic carrier particle is a carrier particle with a mean particle size of 33 μm.

The developing device 4 further comprises a guide member 45 of the developer disposed upstream of the developer restricting member 43 in the direction of rotation of the developing roller 41. The guide member 45 is formed of a non-magnetic material, and is disposed between the developing roller 41 and an inner face 401 of the development housing 40.

The guide member 45 is disposed spaced away from the developing roller 41 via a clearance g2, and provides a developer guide path 46 which guides the developer D to the developer amount restricting clearance g1 between itself and the developing roller 41.

In addition, the guide member 45 is disposed spaced away from the inner face 401 of the development housing via a clearance g6, and provides a developer circulation path 47 for circulating the developer D to an upstream end 451 of the guide member 45 in the direction of rotation of the developing roller between itself and the inner face 401 of the development housing 40.

At the downstream end portion of the guide member 45 in the direction of rotation of the developing roller, or stated more specifically, in a portion close to the developer restricting member 43 (in this example, a position at a distance P from the restricting member 43 on the upstream side), a communication path 48 having a clearance dimension g5 which communicates the developer guide path 46 with the developer circulation path 47 is formed.

At the upstream end 451 of the guide member 45 in the direction of rotation of the developing roller is positioned above the peak of the magnetic flux density of the catch pole S2 herein (in other words, in a position corresponding to the peak of the magnetic flux density of the magnetic pole S2) which is closest to the low-magnetic force area LM downstream of the low-magnetic force area LM.

It is desirable that the face of the guide member 45 facing the developing roller 41 is made highly lubricant with, for example, a coating of a fluorine-containing resin or the like.

In this example, a magnetic flux density Br of the catch pole S2 in the radial direction of the developing roller is 45 mT on the surface of the developing roller 41.

Herein, although not so limited,

Developer amount restricting clearance g1=0.5 mm

Clearance g2 between the guide member 45 and the developing roller 41=1.5 mm Clearance g6 between the guide member 45 and the inner face 401 of the housing=2.0 mm Distance P from the restricting member 43 to the portion where the communication path 48 is formed=3 mm, and Clearance g5 of the communication path 48=1.5 mm.

According to the developing device 4, the developer attracted onto the surface of the developing roller 41 by the magnetic force of the catch pole S2 of the magnetic field generator 42 is transferred to the developer amount restricting clearance g1 under the action of the frictional force by the rotation of the developing roller 41, restricted to a predetermined amount there and transferred to the development area Da in the form of a brush of the developer, and is used for developing the electrostatic latent image on the photosensitive member 1.

The developer which is returned to the development housing 40 in a state of being retained on the developing roller 41 without being consumed in the development area Da peels off from the developing roller 41 in the low-magnetic force area LM.

What is noteworthy here is that, according to the developing device 4, the amount of developer fed to the developing roller 41 is limited by the upstream end 451 of the guide member 45 so that the amount will not be too high. Moreover, since the upstream end 451 of the guide member 45 is positioned correspondingly to the peak of the magnetic flux density of the magnetic pole S2 closest to the low-magnetic force area downstream of the low-magnetic force area LM, the ability of the developing roller 41 to attract developer in the region including the upstream end 451 is not so high, and the stress of the developer in the region is suppressed to a low level.

The guide member 45 further forms the following two paths as developer flow paths before the developer amount restricting portion by the developer restricting member 43.

Path 1: space formed between the developing roller 41 and the guide member 45 (developer guide path 46). In this path 1, the developer D is transferred in the same direction as the direction of rotation of the developing roller.

Path 2: space formed between the guide member 45 and the development housing 40 (developer circulation path 47). In this path 2, the developer D travels in the direction opposite to the direction of rotation of the developing roller. The developer D prevented from being transferred to the development area Da by the developer restricting member 43 flows from the communication path 48 which brings the developer guide path 46 into communication with the developer circulation path 47 to the developer circulation path 47, and travels through this path to the upstream end 451 of the guide member 45 by gravity.

Since the interval between the guide member 45 and the surface of the developing roller in the path 1 is limited by the guide member 45, the amount of the developer accumulated in the developer restricting portion transferred through this path 1 is lower than in the case where no guide member 45 is provided.

Furthermore, the pressure of the developer before the developer restricting portion is released by the communication path 48 which brings the path 1 (developer guide path 46) into communication with the path 2 (developer circulation path 47), and the developer before the developer restricting portion is returned to the upstream end 451 of the guide member 45 (feed portion of the developer) through the path 2. Therefore, the pressure of the developer before the developer restricting portion is prevented from being too high.

Accordingly, the amount of the developer accumulated in the upstream area adjacent to the developer restricting member 43 in the direction of rotation of the developing roller can be reduced while the stress on each particle constituting the developer is suppressed, thereby reducing the stress on the developer in the upstream area adjacent to the developer restricting member 43.

Moreover, from the standpoint of the image forming device 10, since such a two-component developing device 4 is employed, the stress on the developer is suppressed, and deterioration of the developer D generated when the stress on the developer is high and occurrence of image defects and other problems caused thereby are suppressed, and good images can be formed accordingly.

In addition, according to this developing device 4, the amount of the developer accumulated in an upstream area of the developer restricting member 43 can be limited to a low level, and therefore the scrubbing of the developer, which has been prevented from traveling by the restricting member 43, by the developing roller 41 (in other words, the scrubbing reactive force exerted on the developing roller 41) can be also suppressed. Therefore, the rotational torque of the developing roller 41 can be advantageously suppressed to an accordingly low level.

In the example described above, the position of the upstream end 451 of the guide member is set to be a position corresponding to the peak of the magnetic flux density of the magnetic pole S2, but the upstream end 451 of the guide member may be positioned upstream of such a position but downstream of the low-magnetic force area LM. In either case, the position may be within such a range that the feeding of the developer is ensured.

Moreover, in the example described above, the clearance g2 between the guide member 45 and the developing roller 41 is set to 1.5 mm, but this clearance g2 is not necessarily uniform throughout the path 46. For example, the size of the clearance in an upstream portion may be made smaller than that in a downstream portion to prevent packing of the developer.

Figure 5:
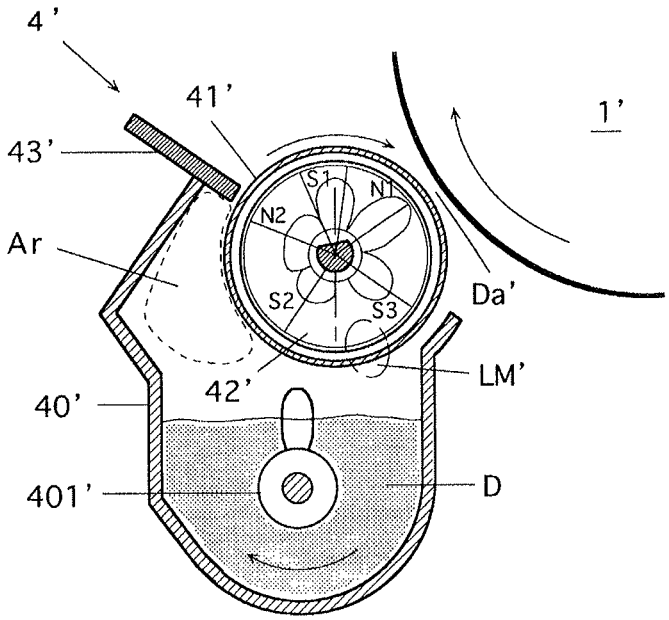
Fig.5 (PRIOR ART)
FIG. 5 shows of a conventional example of a two-component developing device.
Figure 6:
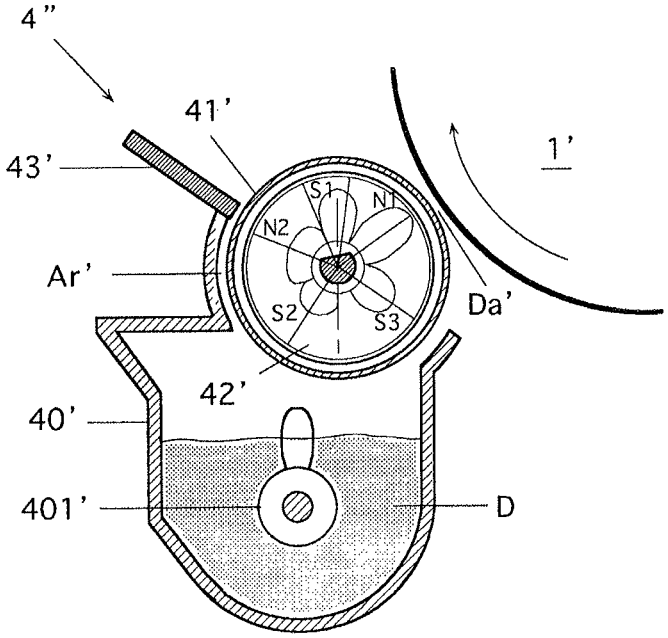
Fig.6 (PRIOR ART)
FIG. 6 shows an improved example of the developing device of FIG. 5.

The rotational torques of developing rollers determined for the developing device 4 shown in FIG. 2 and the conventional developing device 4' shown in FIG. 5 will be now described.

In the developing devices 4 and 4', the developing rollers, magnetic field generators, developer restricting members and other components employed were the same. The peripheral speed of the developing rollers was 302 mm/sec. in both devices.

When the amount of the developer accumulated in an upstream area of the developer restricting member is high, the scrubbing force of developer by the developing roller is increased, and the rotational torque of the developing roller is increased. However, FIG. 4 shows that the rotational torque of the developing roller in the developing device 4 is lowered than in the developing device 4' (lower by about 20%) and the amount of the developer accumulated in an upstream area of the developer restricting member is suppressed to a low level (and thus the stress on the developer is suppressed accordingly).

Figure 4:
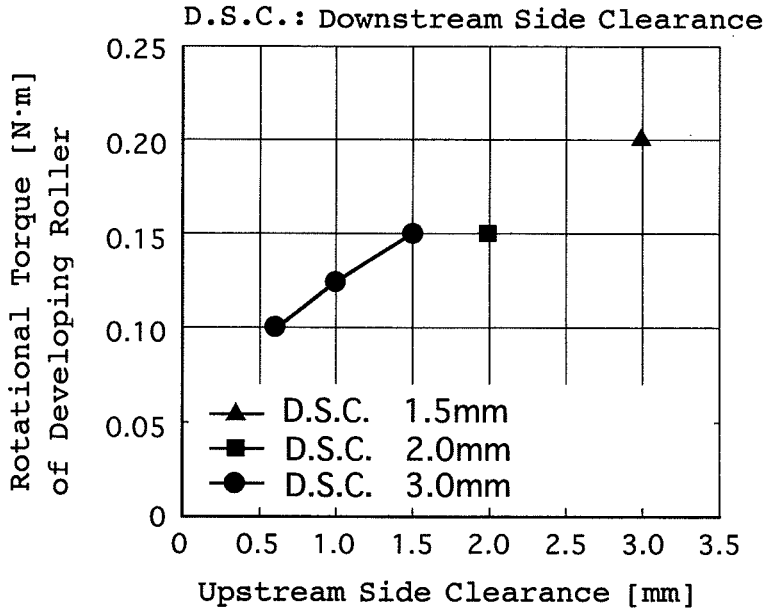
FIG. 4 shows the results of the determination of the influence of the clearance of the upstream end of the guide member and the clearance of the downstream end of the same in the clearances between developer guide member and developing roller on the rotational torque of the developing roller.

Moreover, variation in the rotational torque of the developing roller when the clearance between the downstream end portion of the guide member 45 and the developing roller (Downstream Side Clearance) was changed to 1.5 mm, 2.0 mm and 3.0 mm and the clearance between the upstream end of the guide member and the developing roller (Upstream Side Clearance) was changed with respect to the clearances described above were determined, giving the results shown in FIG. 4.

As can be seen from FIG. 4, the clearance between the guide member 45 and the developing roller 41 may be approximately set smaller than 2 mm.

The guide member 45 may be constructed integrally with the development housing 40 to decrease the number of the parts of the developing device.

Although the image forming device described above is for forming monochrome images, the present invention can be also applied to image forming devices for forming color images. In that case, the two-component developing device according to the present invention may be employed in one or more of a plurality of the developing devices each containing toner of an associated color for forming color images.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A two-component developing device which is capable of forming a toner image by developing an electrostatic latent image formed on an electrostatic latent image carrier with a developer containing toner and magnetic carrier particles, the two-component developing device comprising a development housing for containing the developer, a developing roller which is provided on the development housing and can be rotationally driven, a magnetic field generator mounted inside the developing roller and having a plurality of magnetic poles for attracting the developer used for development in the development housing onto a surface of the developing roller and meanwhile for providing a low-magnetic force area where the developer returned into the development housing without being used in development in a state of being left attracted on the developing roller is separated from the developing roller, a developer restricting member which restricts an amount of the developer attracted onto the surface of the developing roller by the magnetic force of the magnetic field generator and transferred to an electrostatic latent image development area by rotation of the developing roller, the developer restricting member opposing the developing roller across a developer amount restricting clearance, the two-component developing device comprising a developer guide member disposed between the developing roller and an inner face of the development housing in an area upstream of the developer restricting member in a direction of rotation of the developing roller, the guide member providing a developer guide path for guiding the developer to a developer amount restricting clearance between itself and the developing roller, providing a developer circulation path for circulating the developer to an upstream end of the guide member in the direction of rotation of the developing roller between itself and the inner face of the development housing, and providing a communication path for bringing the developer guide path into communication with the developer circulation path at a downstream end portion of the guide member in the direction of rotation of the developing roller, and the upstream end of the guide member in the direction of rotation of the developing roller being positioned above a peak of a magnetic flux density of the magnetic pole of the magnetic field generator which is closest to the low-magnetic force area downstream of the low-magnetic force area or positioned upstream of such a position and downstream of the low-magnetic force area, the developer restricting member having a wall surface that extends along the direction of rotation of the developing roller in an area downstream of the communication path and upstream of the developer amount restricting area in a direction of rotation of the developing roller.

2. The two-component developing device according to claim 1, wherein the developer circulation path is a path for circulating the developer which flows into itself to the upstream end of the guide member by gravity.

3. The two-component developing device according to claim 1, wherein the device further includes a first developer transfer member which is disposed parallel to the developing roller in a position opposing the developing roller and a second developer transfer member which is disposed parallel to the developing roller and circulates the developer along with the first developer transfer member, and an outlet of the developer circulation path opposes the first developer transfer member.

4. The two-component developing device according to claim 1, wherein a face of the guide member facing the developing roller is coated with a fluorine-containing resin.

5. The two-component developing device according to claim 1, wherein a clearance between the guide member and the developing roller is smaller on the upstream side than on the downstream side in the direction of rotation of the developing roller.

6. An image forming device comprising an electrostatic latent image carrier and a plurality of developing devices for developing a latent image on the electrostatic latent image carrier, and at least one of the plurality of the developing devices being the two-component developing device according to claim 1.

7. The image forming device according to claim 6, wherein the developer circulation path in the two-component developing device is a path for circulating the developer which flows into itself to the upstream end of the guide member by gravity.

8. The image forming device according to claim 6, wherein the two-component developing device further includes a first developer transfer member which is disposed parallel to the developing roller in a position opposing the developing roller and a second developer transfer member which is disposed parallel to the developing roller and circulates the developer along with the first developer transfer member, and an outlet of the developer circulation path opposes the first developer transfer member.

9. The image forming device according to claim 6, wherein a face of the guide member facing the developing roller in the two-component developing device is coated with a fluorine-containing resin.

10. The image forming device according to claim 6, wherein a clearance between the guide member and the developing roller in the two-component developing device is smaller on the upstream side than on the downstream side in the direction of rotation of the developing roller.

* * * * *